United States Patent [19]

Marks

[11] Patent Number: 4,735,388

[45] Date of Patent: Apr. 5, 1988

[54] BABY BOTTLE HOLDER, AND METHODS OF CONSTRUCTING AND UTILIZING SAME

[76] Inventor: Stephen A. Marks, 1390 Bagley, Alpena, Mich. 49707

[21] Appl. No.: 833,546

[22] Filed: Feb. 27, 1986

[51] Int. Cl.[4] ..... A47D 15/00

[52] U.S. Cl. ..... 248/103; 248/278; 248/287

[58] Field of Search ..... 248/103, 104, 278, 283, 248/296, 188.5, 288.5, 481, 287, 279, 106, 107, 105, 124

[56] References Cited

U.S. PATENT DOCUMENTS

| | | | |
|---|---|---|---|
| 1,222,246 | 4/1917 | Schumacher | 248/103 |
| 1,900,691 | 3/1933 | Carlson | 248/102 |
| 2,470,694 | 5/1949 | Foo | 248/106 |
| 2,530,478 | 11/1950 | Parent | 248/103 |
| 2,605,069 | 7/1952 | Gillaspy | 248/103 |
| 2,711,872 | 6/1955 | Lampke | 248/103 |
| 3,377,117 | 4/1968 | Biscow | 248/481 X |

FOREIGN PATENT DOCUMENTS

| | | | |
|---|---|---|---|
| 989305 | 5/1951 | France | 248/103 |

*Primary Examiner*—Ramon S. Britts
*Assistant Examiner*—Karen J. Chotkowski
*Attorney, Agent, or Firm*—Irving M. Weiner; Joseph P. Carrier; William D. Blackman

[57] ABSTRACT

A bottle holding apparatus which operably attaches to a member, comprising, a first clamping means which operably attaches to said member, a first elongated member having a first end and a second end pivotally connected at said first end to said first clamping means, a hollow elongated member having first and second ends which is provided at said first end with an opening for slidingly receiving said second end of said first elongated member, an external thread, and at least on side slot, and a second clamping means pivotally connected to said second end of said hollow elongated member for receiving and gripping said bottle.

9 Claims, 1 Drawing Sheet

BABY BOTTLE HOLDER, AND METHODS OF CONSTRUCTING AND UTILIZING SAME

BACKGROUND OF THE INVENTION

1. Field of the Invention

The instant invention relates broadly to a receptacle holding device, and more particularly to support devices for infant feeding bottles and the like.

Infants require frequent feedings throughout the day. Such frequent feedings are usually at inconvenient times and locations. For example, infants are frequently transported in strollers or carriages during shopping trips, social visits by an infant's mother, or the like. During such trips it is normally inconvenient to stop and feed the infant when such demand arises. Additionally, the act of standing over a crib to constantly hold a bottle up to an infant's mouth is a time consuming and laborious task.

2. Description of Relevant Art

While the prior art contains several forms of devices intended for holding nursing bottles during baby feeding, they all have apparently fallen short of expectations for one reason or another as they are not readily available in commerce. These holders have certain drawbacks in that they lack the stability and versatility necessary for effectively accomplishing that purpose of saving time for the busy parent.

Examples of related inventions may be found in U.S. Pat. Nos. 2,496,478, 2,530,478, 2,738,152, and 4,482,117. These inventions, while similar in purpose to the present invention, fail to disclose or teach its structure. Additionally, these above-identified related inventions have the common disadvantage of not being susceptible to attachment to a wide variety of items, thereby rendering them useless for many of those instances where an infant is in a vicinity that does not have a suitable member for them to be attached to. The present invention because of its adjustability and versatility is well able to cope with almost any given situation where an infant is placed.

SUMMARY OF THE INVENTION

The present invention discloses a bottle support comprising a U-shaped clamp having one one side a threaded aperture and on the other opposite exterior side a relatively short integral member having a ball shaped end, a first threaded thumbscrew adapted to said aperture and U-shaped clamp having on the interior of the clamp a cap which turns independent of the thumbscrew, a plurality of ball retainers, a plurality of arm sections, said arm sections being cylindrical elongated members have indented ends terminating in balls and joined together with said U-shaped clamp by one of said ball retainers, a circular clamp for holding a bottle having a relatively short integral protrusion terminating in a ball which is adapted to said ball retainers used to connect said plurality of arm sections, said bottle clamp also having a split in its side opposite that having the relatively short protrusion in it, and flanges protruding outwardly from said split which have threaded apertures facing each other, and which may be connected by a thumbscrew which will pull them together, thereby providing a means for tightening and loosening said bottle clamp.

A first object of the present invention disclosure is to provide a nursing bottle support that will adapt to a variety of items to which it may be secured.

A second object of the present invention is to provide a support which may be adapted to almost any position the baby will be in.

A third object of the present invention is to provide an inexpensive, easily manufactured, simple to operate baby bottle support to relieve parents and other caretakers of infants from the constant attention required to feed them.

DETAILED DESCRIPTION OF THE PREFERRED EMBODIMENTS

Figure 1:
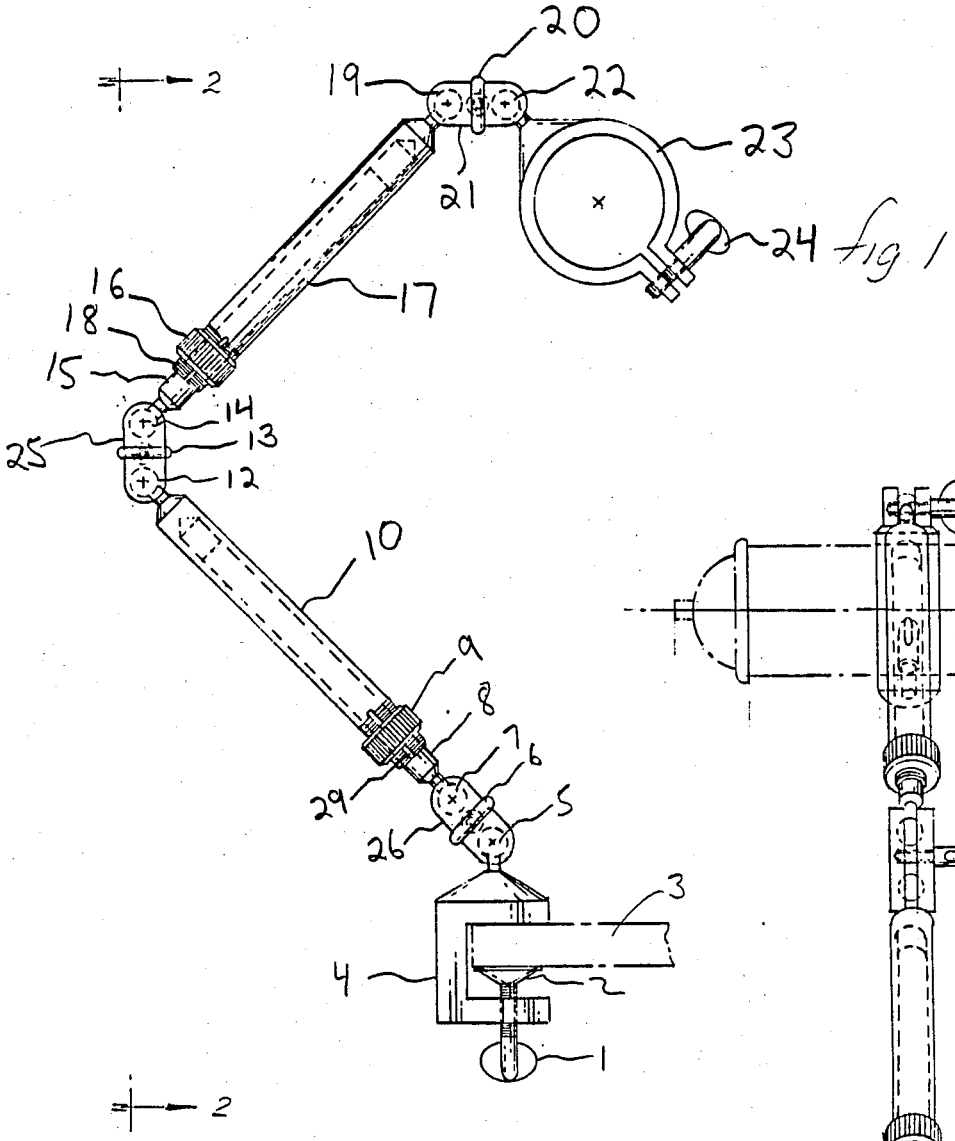
FIG. 1 represents a side elevational view of the invention 3 attached to a member 3 which may be anything, e.g., a portion of a crib, a stroller, a kitchen cabinet, etc.

In FIG. 1 is shown the invention 30 in a nonoperational mode. However, clamp 4 has been attached to member 3 with the aid of thumb screw 1 which has cap 2 on its end. Cap 2 is capable of rotating independently of thumb screw 1, and so is pivotally connected to thumb screw 1. It should be further noted that thumb screw 1 traverses a threaded aperture in the side of clamp 4. On the outside of clamp 4 is a ball shaped member 5 which is received in a retainer 26. Said retainer 26 also receives a ball like member 7 formed on a first end of cylindrical rod 8. Said retainer 26 may be tightened or loosened for adjustability as desired by the turning of thumb screw 6 which actuates its tension. Cylindrical rod 8 is telescopingly received into hollow cylinder 10 which has a threaded end having a side slit 29 therein. Such threaded end may be clamped onto cylindrical rod 8 by the movement of nut 9. Hollow cylinder 10 terminates in a ball like member 12 which is received in a retainer 25 which also receives a ball like member 14 formed on the end of cylindrical rod 15. Retainer 25 is actuated by thumb screw 13. Cylindrical rod 15 telescopingly engages with hollow cylinder 17 which has threaded end 18 which may be caused to clamp down on cylindrical rod 15 by movement of nut 16. Hollow cylinder 17 terminates in a ball like member 19 which is received in a retainer 21 which also receives a ball like 22 member formed on clamp 23. Retainer 21 is actuated by thumb screw 20. Clamp 23 is substantially circular in configuration, and will be constructed of a predetermined size. However, clamp 23 may have its size varied by thumbscrew 24 which may be used to tighten it.

As indicated above, the length of reach of invention 30 may be varied not only by the number of cylindrical rods, for example, 8 and 15 and hollow cylinders, e.g., 10 and 17, but also by telescoping said sections outwardly or inwardly as desired. Furthermore, it should be noted that the versatility and adjustability of the invention 30 does not simple reside in being able to vary its reach, but also in being able to adjust it via the retainers 21, 25 and 26 into a variety of straight or crooked positions.

From the foregoing description it will be understood that the three pairs of ball members 19, 22; 12, 14; and 5, 7, together with the respective retainers 21, 25 and 26, define three separate double universal joint connections. Such arrangement affords maximal variation in adjustment of the invention to accommodate even the most minute necessary angular adjustments for precisely positioning the baby bottle relative to the baby. In addition, because the retainers 21, 25 and 26 are of the same construction; as are the cylinder rods 8, 15 and the hollow cylinders 10, 17; the invention permits interchangeability of various component parts to facilitate both use and manufacture of the invention.

Figure 2:
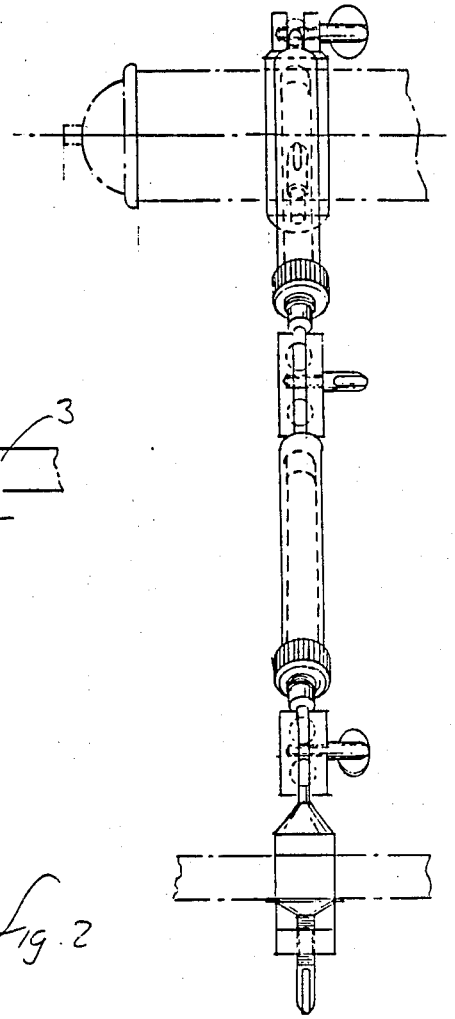
FIG. 2 is a top plan view of the invention in use, again clampled to some member, holding in a clamp an infant feeding bottle with the feeding end of the bottle pointing to the left.

Turning to FIG. 2, there is shown the invention 30 is an operational mode holding a feeding bottle with circular clamp 23, from which it can easily be seen how invention 30 will be utilized. Obviously, the bottle could be turned downward if so desired. Furthermore, while invention 30 shows only two sections of corresponding hollow cylinders and cylindrical rods 10, 11, 17, and 15, it can easily be envisioned from this drawing that sections in other embodiments may be removed or added, or take different configurations. This represents an advantage over other related inventions. Other related inventions do not teach the use of such advantages either specifically or in the abstract.

It should also be noted that the present invention 30 could be easily adapted for use with people of any age who are unable to take care of themselves, e.g., the injured, the elderly, or the hospitalized.

It should be understood that the above-disclosed invention 30 is the preferred embodiment and that variations and modifications can of course be made thereto and that the applicant is not disclaiming those. The present invention 30 will be better understood from the appended claims.

What is claimed is:

1. A bottle holding apparatus which operably attaches to a member, comprising:

a first clamping means which is substantially U-shaped;

said first clamping means being provided with a ball-shaped member on the exterior thereof;

a first elongated member and a second elongated member;

said first elongated member and said second elongated member each comprising an exterior portion having one substantially ball-shaped end and an interior portion having one substantially ball-shaped end, said interior portions being slidingly received into said exterior portions;

said ball-shaped end of said exterior portion of said first elongated member being pivotally connected to said ball-shaped end of said interior portion of said second elongated member;

said ball-shaped end of said interior portion of said first elongated member being pivotally connected to said first clamping means;

a second clamping means pivotally connected to the ball shaped end of said exterior porion of siad second elongated member;

said bottle being gripped by said second clamping means;

a third clamping means operable attached to the receiving end positioned opposite said ball-shaped end of said exterior portion of said first elongated member for fixing the relative position of said interior portion of said first elongated member therein;

a fourth clamping means operably attached to the receiving end positioned opposite said ball-shaped end of said exterior portion of said second elongated member for fixing the relative position of said interior portion of said second elongated member therein;

a first retainer means provided with at least two cavities for receiving said ball-shaped member of said first clamping means and said ball-shaped end of said interior portion of said first elongated member, so as to define a first double universal joint connection;

a second retainer means provided with at least two cavities for receiving said ball-shaped member of said second clamping means and said ball-shaped end of said exterior portion of said second elongated member, so as to define a second double universal joint connection; and a third retainer means provided with at least two cavities for receiving said ball-shaped end of said exterior portion of said first elongated member and said ball-shaped end of said interior portion of said second member, so as to define a third double universal joint connection.

2. The apparatus of claim 1, wherein:

said first clamping means includes a thumbscrew operably connected thereto.

3. The apparatus of claim 2, wherein:

said thumbscrew includes a cap rotatably mounted on the end which operably engages said member; and said cap may turn independently of said thumbscrew.

4. The apparatus of claim 1, wherein:

said second clamping means includes a thumbscrew operably engaged therewith.

5. A bottle holding apparatus according to claim 1, wherein: said third clamping means comprises:

an external threaded and at least one side slot provided on said receiving end of said exterior portion of said first elongated member;

a first tightening member having an inner thread compatible with said thread on said receiving end of said exterior portion of said first elongated member, said first tightening member being manually rotatable to loosen said receiving end of said exterior portion of said first elongated member for adjusting the extent to which said interior portion of said first elongated member extends therefrom; and said fourth clamping means comprises:

an external threaded and at least one side slot provided on said receiving end of said exterior portion of said second elongated member;

a second tightening member having an inner thread compatible with said thread on said receiving end of said exterior portion of said second elongated member, said second tightening member being manually rotatable to loosen said receiving end of said exterior portion of said second elongated member for adjusting the extent to which said interior portion of said second elongated member extends therefrom.

6. A bottle holding apparatus according to claim 1, wherein:

said first and second elongated members are relatively interchangeable.

7. A bottle holding apparatus according to claim 1, wherein:

said first, second and third retainer means are relatively interchangeable.

8. A bottle holding apparatus according to claim 1, wherein:

said first and second elongated members are relatively interchangeable; and said first, second and third retainer means are relatively interchangeable.

9. A bottle holding apparatus according to claim 7, wherein:

each of said first, second and third retainer means are provided with a thumbscrew for adjustng the tension thereof.

* * * * *

UNITED STATES PATENT AND TRADEMARK OFFICE

CERTIFICATE OF CORRECTION

PATENT NO. : 4,735,388

DATED : April 5, 1988

INVENTOR(S) : MARKS

It is certified that error appears in the above-identified patent and that said Letters Patent is hereby corrected as shown below:

Column 1, line 47, after "having" change "one" (first occurrence) to --on--.
Column 2, line 15, delete "3" (both occurrences);
line 19, correct the spelling of --clamped--;
line 63, change "simple" to --simply--.
Column 3, line 12, after "30" change "is" to --in--;
line 58 (claim 1, line 23), correct the spelling of --portion--; correct the spelling of --said-- (second occurrence).
Column 4, line 35 (claim 5, line 3), after "threaded" insert --end--;
line 49 (claim 5, line 16), after "threaded" insert --end--.
In the Abstract, line 9, change "on" to --one--.

Signed and Sealed this

Twenty-seventh Day of September, 1988

*Attest:*

DONALD J. QUIGG

*Attesting Officer*

*Commissioner of Patents and Trademarks*